US006767038B1

(12) United States Patent
Huml

(10) Patent No.: US 6,767,038 B1
(45) Date of Patent: Jul. 27, 2004

(54) MULTI-POINT CASEMENT HANDLE

(75) Inventor: Jan M. Huml, Medford, WI (US)

(73) Assignee: G-U Hardware, Inc., Newport News, VA (US)

( * ) Notice: Subject to any disclaimer, the term of this patent is extended or adjusted under 35 U.S.C. 154(b) by 0 days.

(21) Appl. No.: 10/067,824

(22) Filed: Feb. 8, 2002

Related U.S. Application Data

(60) Provisional application No. 60/267,149, filed on Feb. 8, 2001.

(51) Int. Cl.[7] ..... E05C 1/06; E05C 1/12

(52) U.S. Cl. ..... 292/158; 292/34; 292/137; 292/139; 292/157; 292/162; 292/336.3; 292/DIG. 20; 292/DIG. 38

(58) Field of Search ..... 292/156–162, 292/336.3, DIG. 20, DIG. 38, 139, DIG. 33, 40, 36, 118, 257, 34

(56) References Cited

U.S. PATENT DOCUMENTS

| | | | | | |
|---|---|---|---|---|---|
| 296,402 | A | * | 4/1884 | Goforth | 292/101 |
| 2,214,280 | A | | 9/1940 | Lang | |
| 2,811,349 | A | | 10/1957 | Bondurant et al. | |
| 2,950,509 | A | | 8/1960 | Stavenau | |
| 3,114,542 | A | | 12/1963 | Ahlgren | |
| 3,422,575 | A | | 1/1969 | Armstrong | |
| 3,811,718 | A | * | 5/1974 | Bates | 292/241 |
| 3,949,525 | A | | 4/1976 | Bates et al. | |
| 4,059,298 | A | | 11/1977 | Van Klompenburg | |
| 4,095,827 | A | | 6/1978 | Stavenau | |
| 4,095,829 | A | | 6/1978 | Van Klompenburg | |
| 4,241,541 | A | | 12/1980 | van Klompenburg et al. | |
| 4,253,276 | A | | 3/1981 | Peterson et al. | |
| 4,266,371 | A | | 5/1981 | Erdman et al. | |
| 4,305,228 | A | | 12/1981 | Nelson | |
| 4,429,910 | A | | 2/1984 | Anderson | |
| 4,497,135 | A | | 2/1985 | Vetter | |
| 4,617,758 | A | | 10/1986 | Vetter | |
| 4,621,847 | A | | 11/1986 | Paulson et al. | |
| 4,634,160 | A | * | 1/1987 | Lahmann et al. | 292/336.3 |
| 4,801,164 | A | | 1/1989 | Mosch | |
| 4,813,725 | A | | 3/1989 | Mosch | |
| 4,872,716 | A | | 10/1989 | Legrand et al. | |
| 4,930,820 | A | | 6/1990 | Pettit et al. | |
| 4,937,976 | A | | 7/1990 | Tucker et al. | |
| 4,945,678 | A | | 8/1990 | Berner et al. | |
| 4,991,886 | A | | 2/1991 | Nolte et al. | |
| D316,509 | S | | 4/1991 | Nolte | |
| 5,080,407 | A | * | 1/1992 | Evers | 292/241 |
| 5,087,087 | A | | 2/1992 | Vetter et al. | |
| 5,118,145 | A | | 6/1992 | Tucker | |
| 5,152,103 | A | | 10/1992 | Tucker et al. | |

(List continued on next page.)

FOREIGN PATENT DOCUMENTS

| | | | |
|---|---|---|---|
| DE | 2341263 | * | 3/1974 |
| GB | 2194280 | * | 7/1987 |
| GB | 2208891 | * | 8/1988 |

*Primary Examiner*—J. J. Swann
*Assistant Examiner*—Carlos Lugo
(74) *Attorney, Agent, or Firm*—James Creighton Wray; Meera P. Narasimhan

(57) ABSTRACT

A plastic casement windows operator has a plastic housing, a plastic sliding tounge and a plastic operating lever. The housing has a plastic main body and a plastic cover with complementary peripheral steps and peripheral energy directors and inward extending receivers and pins with energy directors for joining the cover and main body after the plastic sliding tounge and plastic operating lever are installed. The main body has an inward extending cylindrical bearing opening, which holds a cylindrical bearing integrally formed between an operating handle and an activator arm. An activator cylinder at a remote end of the arm moves in an oval groove in the sliding tounge. Wings on the tounge support opposite jugs and cylindrical guides which slide along inner guides on the cover and main body. An extension on the flat body tounge has a U-shaped opening for connecting a window linkage. Integral rims extend around the tounge, the U-shaped opening and the oval groove.

18 Claims, 5 Drawing Sheets

U.S. PATENT DOCUMENTS

D334,132 S 3/1993 Wobschall et al.
RE34,230 E 4/1993 Tucker et al.
5,199,216 A 4/1993 Vetter et al.
5,205,074 A 4/1993 Guhl et al.
5,272,837 A 12/1993 Nolte et al.
5,318,333 A 6/1994 Dreifert
5,370,428 A * 12/1994 Dreifert et al. ..... 292/161
5,414,899 A 5/1995 Raetz
5,437,173 A 8/1995 Spinar
5,448,857 A 9/1995 Stormo
D366,409 S 1/1996 Delaske
5,489,131 A 2/1996 Blom
5,582,445 A * 12/1996 Olsen et al. ..... 292/241
5,599,049 A * 2/1997 Kockel ..... 292/102
D390,445 S 2/1998 Johnson et al.
5,725,260 A 3/1998 Eikmeier et al.
5,730,477 A * 3/1998 Nagy ..... 292/32
5,741,031 A 4/1998 Bauman et al.
5,765,308 A 6/1998 Anderson et al.
5,778,602 A 7/1998 Johnson et al.
5,802,913 A 9/1998 Winner
5,815,984 A 10/1998 Sheets et al.
5,839,767 A 11/1998 Piltingsrud
5,901,499 A 5/1999 Delaske et al.
5,927,771 A 7/1999 Simon et al.
5,937,582 A 8/1999 Taylor
6,007,114 A 12/1999 Hotzl
6,044,587 A 4/2000 Vetter et al.
6,109,668 A * 8/2000 Demarco ..... 292/161
6,122,863 A 9/2000 Tippin et al.
6,128,858 A 10/2000 Vetter et al.
6,142,541 A 11/2000 Rotondi
6,161,881 A 12/2000 Babka et al.
6,167,662 B1 1/2001 Gruber
6,431,620 B2 * 8/2002 Tremblay et al. ..... 292/263
6,450,554 B1 * 9/2002 Rotondi et al. ..... 292/158

* cited by examiner-

A
A 41
45
43

45
43
65
47
51
49

A
A 43
45
47
65
49
51

45
43

A
A
B
B
67
55
55
71
5

57
59

MULTI-POINT CASEMENT HANDLE

This application claims the benefit of U.S. Provisional Application No. 60/267,149, filed Feb. 8, 2001.

BACKGROUND OF THE INVENTION

Most window operators are manufactured from metal housings and bases, which typically house a worm gear and activating guide arms. The metal housings are prone to extreme heat conductivity. The metal housings may produce condensation on the interior side of windows fitted with the rotary operators. Condensation occurs at the location of the metal operator. Also, those types of metal operators are in need of paint finishes. Both the metal and the paint are likely to corrode over a period of time.

The other operators on the market are produced from a die-cast zamack material, which breaks down in a seacoast application. The metal therefore requires some type of finish on the outer surface. The interior surfaces of the operator, which includes the operating gears, are left unfinished. Thus, the unfinished interior of the body and the worm gear are prone to corrosion.

Another problem with metal operators is that the metal of the base housing and the metal of the worm-gear are different metals. Dissimilar metals promote corrosion of parts. Having dissimilar metals in contact creates additional force and friction between the parts, thus causing a high factor of wear on the parts. The high factor of wear increases the chances of the parts failing. The metal operators also conduct heat at a much greater rate than other material types.

Prior art devices require gears for actuating rotary operators. Plastic devices have been proposed which use racks and pinions made of plastic.

Needs exist for window operators that are not subject to corrosion that conduct heat at a low rate, thereby eliminating condensation, that readily accept coatings, that do not have dissimilar metals, and that do not have a plurality of fine tooth gears in contact.

SUMMARY OF THE INVENTION

The present invention relates to window operators, and more specifically, to operators for casement windows.

A preferred embodiment has four major parts and two bearing rings. The four major parts are made of strong, rigid polymer. The bearing rings may be made of polypropylene or other self-lubricating polymer. The four major parts are a main body, a cover, an operating handle and a sliding tongue.

The parts of the window operator are produced from polymers, which are non-corrosive and non-thermal conducting. The handle with the attached operator arm is inserted through the cover. The sliding tongue is placed within the main body. The end of the operator arm is placed in a groove in the sliding tongue before pressing the cover onto the main body and fusion welding the cover to the main body. The cover and body components are sonic welded with the sliding tongue and the actuator arm held inside of the plastic base of the window operator, creating a one-piece assembly.

The use of the plastic polymer for the base housing, as well as for the arm and the actuator, eliminates the possibility of corrosion of the base material. Also, the polymer does not require finishing or painting to protect it from corrosion.

A plastic casement windows operator has a plastic housing, a plastic sliding tounge and a plastic operating lever. The housing has a plastic main body and a plastic cover with complementary peripheral steps and peripheral energy directors and inward extending receivers and pins with energy directors for joining the cover and main body after the plastic sliding tounge and plastic operating lever are installed. The main body has an inward extending cylindrical bearing opening, which holds a cylindrical bearing integrally formed between an operating handle and an activator arm. An activator cylinder at a remote end of the arm moves in an oval groove in the sliding tounge. Wings on the tounge support opposite jugs and cylindrical guides which slide along inner guides on the cover and main body. An extension on the flat body tounge has a U-shaped opening for connecting a window linkage. Integral rims extend around the tounge, the U-shaped opening and the oval groove.

These and further and other objects and features of the invention are apparent in the disclosure, which includes the above and ongoing written specification, with the claims and the drawings.

DETAILED DESCRIPTION OF THE PREFERRED EMBODIMENTS

Figures 1, 2, 3, 4, 5, 6, 7:
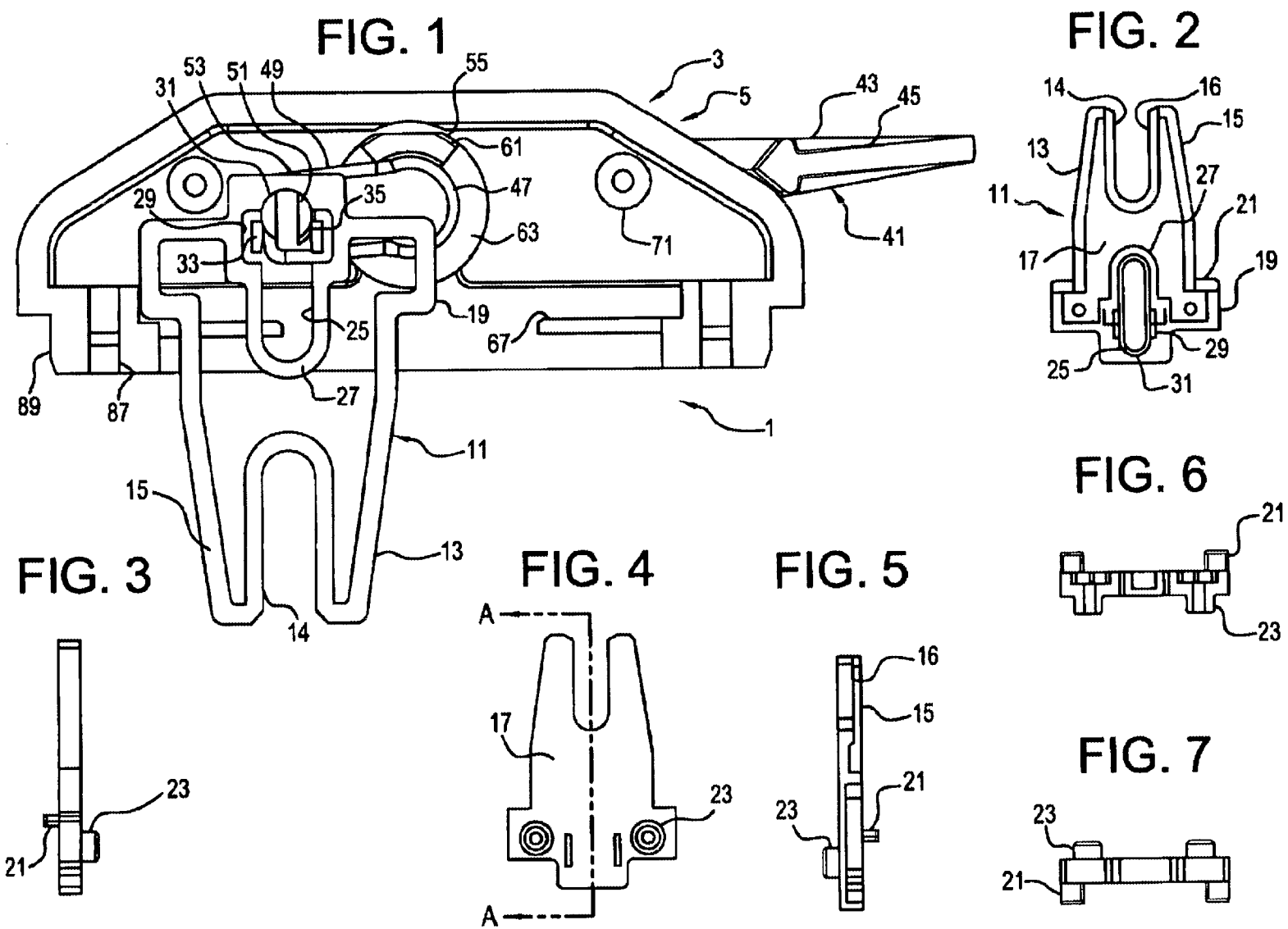
FIG. 1 is a schematic representation of the window operator.
FIGS. 2–7 are top, side, bottom cross-sectional and end views of the tongue.
Figures 8, 9, 10, 11, 12, 13, 14, 15, 16, 17, 18, 19, 20:
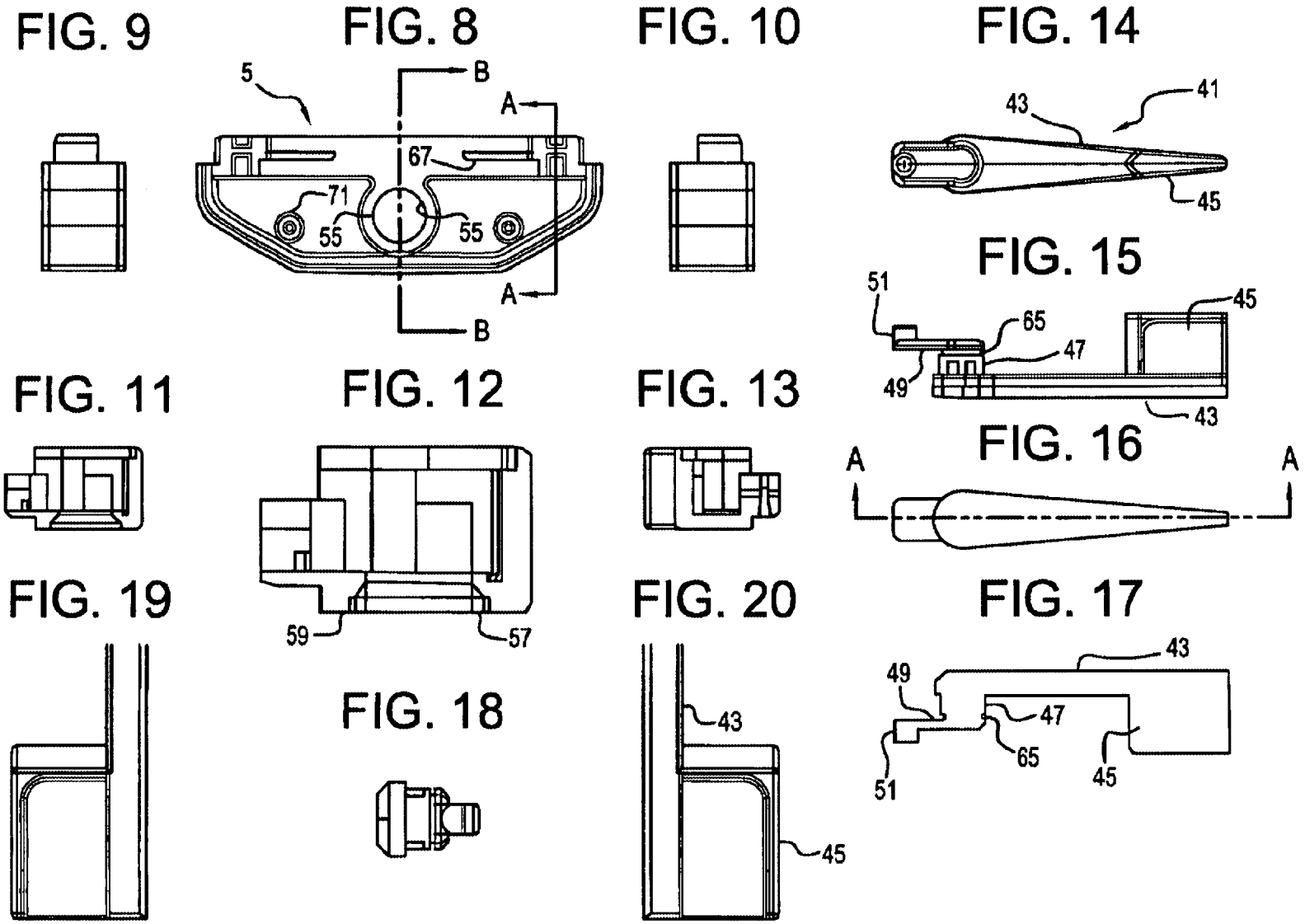
FIGS. 8–13 are top, side, cross-sectional and end views of the main body.
FIGS. 14–20 are bottom, side, top and end details of the handle.
Figure 22:
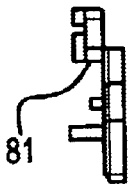
FIGS. 21–27 are inner, outer, side and end views and an edge detail of the cover.
Figure 21:
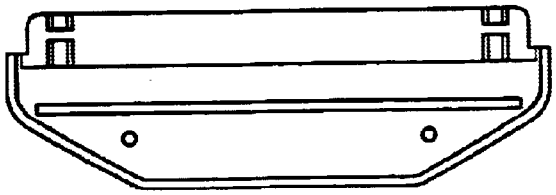
Figure 25:
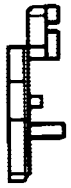
Figure 23:
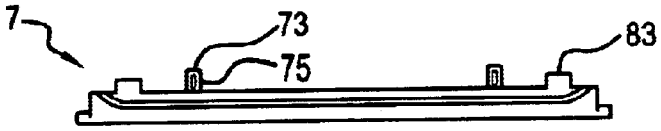
Figure 24:
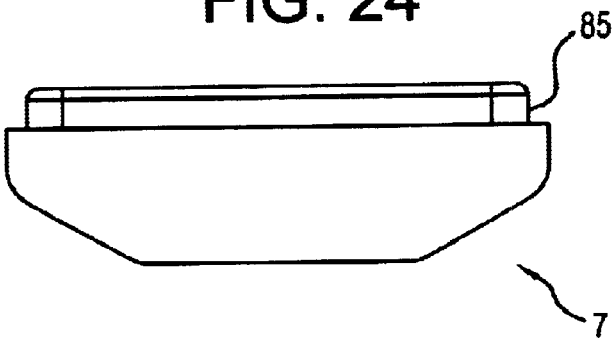
Figure 26:
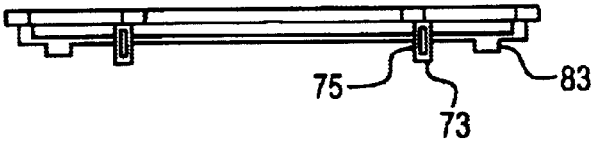
Figure 27:
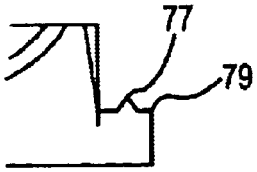
Figure 28:
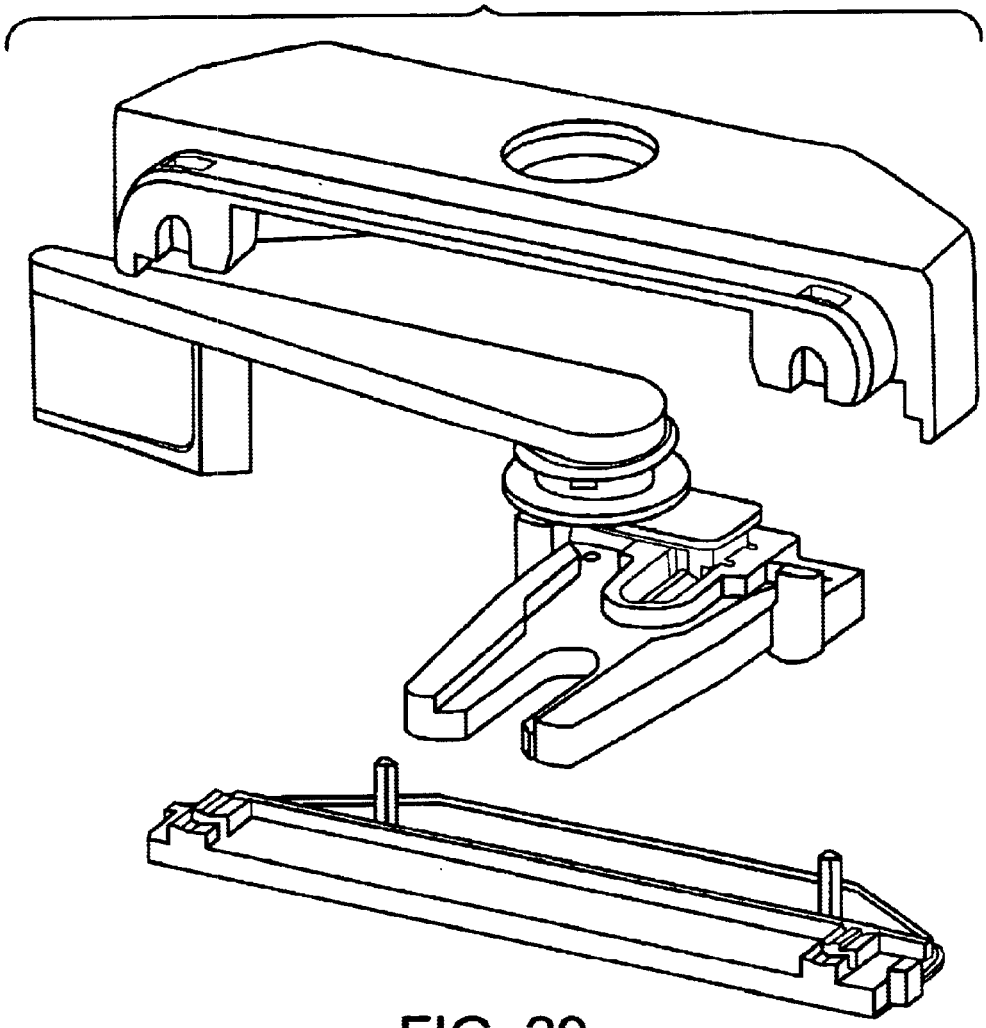
FIG. 28 is an exploded view of the window operator.
Figure 29:
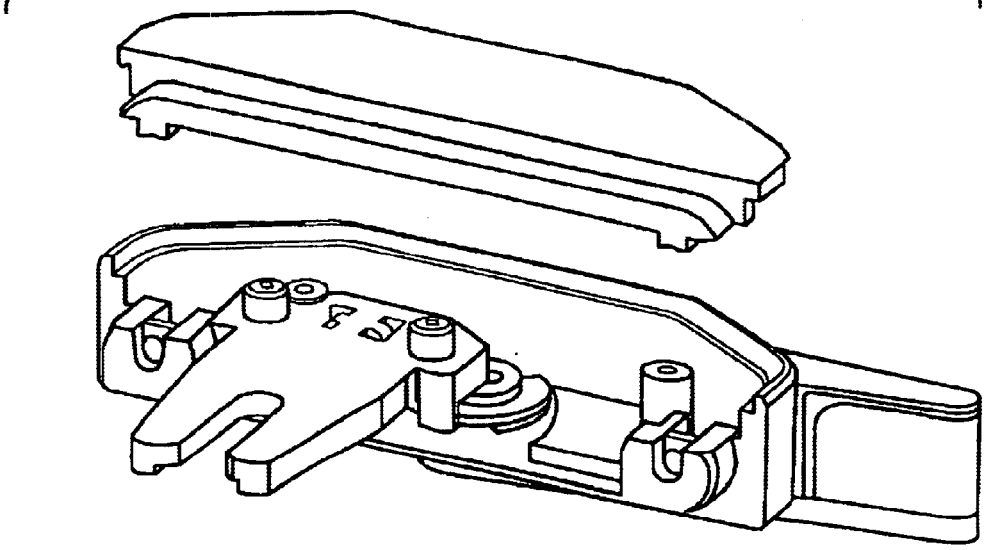
FIG. 29 shows the assembled parts before joining the cover.
Figure 30:
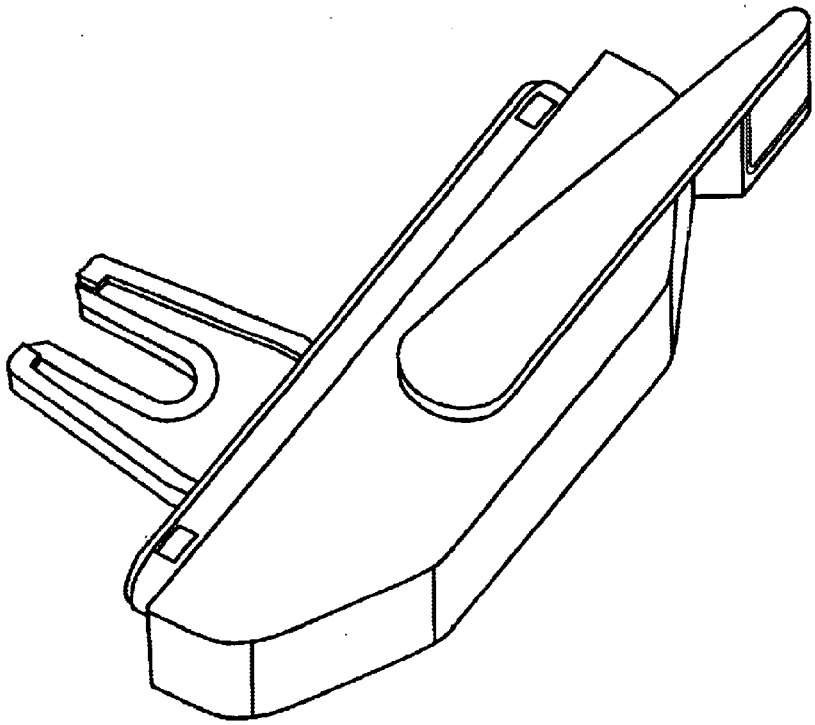
FIGS. 30 and 31 show extreme and middle positions of the handle and tongue.
Figure 31:
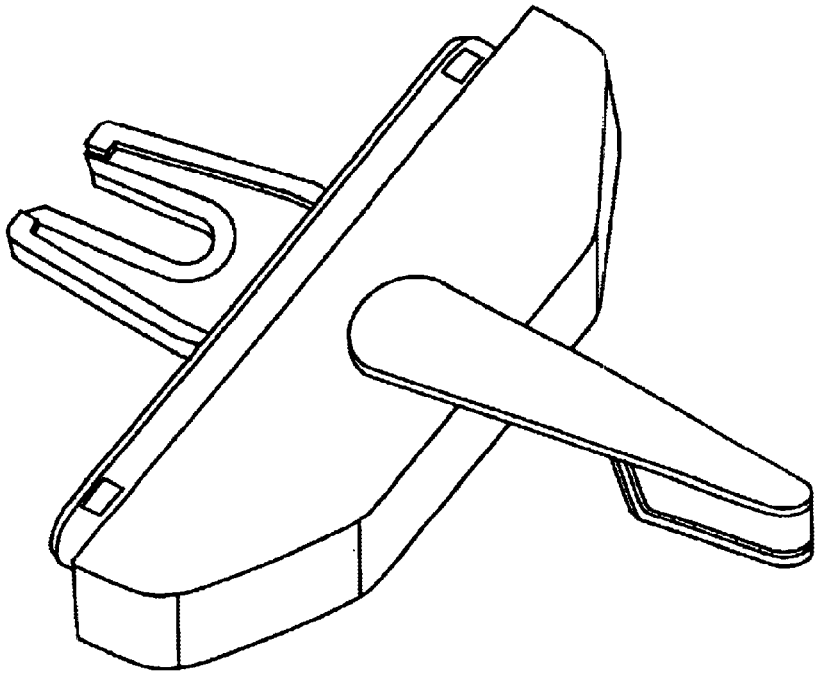

As shown in the drawings, the window operator 1 has a housing 3 made of a main body 5

A sliding tongue 11 that fits between the main body and cover has an extension 13 with a U-shaped opening 14 which engages a conventional mushroom connector on a window-moving linkage. A rim 15 extends partially around the flat body 17 of the sliding tongue 11 to give strength to the flat body. A thinner rim 16 extends around the U-shaped opening 14 to provide a guide surface around the U-shaped opening. Wings 19 extend from the flat body, and guiding lugs 21 extend from the wings 19 beyond the rim 15. Cylindrical guides 23 extend from the flat body 15 opposite from the lugs 21. An oval groove 25 is formed in the flat body and is surrounded by an oval rim 27. The oval groove 25 and rim 27 are spaced from and aligned with the U-shaped opening 14.

In a preferred embodiment, the oval groove 25 and rim 27 have recesses 29 extending laterally from an end 31 remote from the U-shaped opening 14.

Curved lugs 33 within those recesses have inner surfaces 35 which snap over an actuating cylinder as later described to positively hold the sliding tongue in extreme positions against unwanted unintentional movements away from fully closed or fully opened positions.

A handle 41 has an external movable lever 43 with a large, generally flat shaped end 45 for moving by a user. A cylindrical bearing 47 is provided at the inner end of lever 43. An actuator arm 49 extends radially from the bearing 47 diametrically opposite to the lever 43. The actuating cylinder 51 extends from the remote end 53 of the actuator arm. The bearing 47 and actuating cylinder have parallel axes.

Main body 5 has an elongated shape with a central bearing opening 55 which receives the cylindrical bearing 47 of the handle 41.

A recess 57 in the outer surface 59 around the bearing opening 55 receives a bearing ring 61 that is inserted in recess 57 or slipped over the cylindrical bearing 47 from the actuator arm end 53 before the actuator arm end and cylindrical bearing 47 are inserted in the bearing opening 55. A bearing retainer ring 63 is inserted in a recess 65 in the cylindrical bearing after it has been inserted through the bearing opening 55. The retainer ring 63 may be a large flexible ring pulled into place over the actuator arm end 53 or a C-shaped snap ring.

The main body 5 has a guide 67 that guides the lugs 21 on the tongue 11. The main body also has inward extending reinforced tubular receivers 71 that receive inward projecting pins 73 on the cover 7. The inward projecting pins 73 have radially extending energy directors 75. The cover has peripheral energy directors 77 which fit in peripheral steps 79 in the main body 3.

The cover also has an inward ledge 81 which provides a guide for the cylindrical extensions 23 on the tongue 11.

After the actuator arm end 53 has been inserted in the bearing ring 61 and bearing opening 55, the retainer ring 63 is positioned in recess 65. The tongue is placed in the main body 5 with the actuating cylinder 51, one end 53 of arm 49 inserted in the oval recess 25 in the tongue. The cover is aligned with the main body and the pins are inserted in the tubular receivers, and the cover and main body are clamped together with continuous inward force in a press while ultrasonic energy is applied to heat the cover and main body and to fuse them together in the areas of the energy directors.

Semi cylindrical-shaped mounts 83 on extensions 85 of cover 7 align with mounts 87 on extension 89 of the main body to receive threaded mounting fasteners.

Moving the handle from one extreme position to the other moves the actuator cylinder in the cylindrical groove, and thereby traverses the tongue between extreme positions.

While the invention has been described with reference to specific embodiments, modifications and variations of the invention may be constructed without departing from the scope of the invention, which is defined in the following claims.

I claim:

1. Casement window operator apparatus comprising a plastic polymer housing having a plastic main body and a plastic cover, a plastic sliding tongue fitted between the cover and the main body for sliding laterally therein, an extension on the sliding tongue, a U-shaped opening in the extension for engaging a connector on a window-moving linkage, a plastic lever connected to the main body for pivoting therein and connected to the plastic sliding tongue for sliding the tongue in the plastic polymer housing as the lever is moved, wherein the sliding tongue further comprises a flat body and a relatively thick rim extending around the flat body.

2. The apparatus of claim 1, further comprising a relatively thinner rim extending around the U-shaped opening.

3. The apparatus of claim 1, further comprising wings extending from the flat body and guide lugs extending from the wings.

4. The apparatus of claim 3, further comprising cylindrical guides extending from the flat body opposite from the lugs.

5. The apparatus of claim 1, further comprising an oval groove formed in the flat body and surrounded by an oval rim.

6. Casement window operator apparatus comprising a plastic polymer housing having a plastic main body and a plastic cover, a plastic sliding tongue fitted between the cover and the main body for sliding laterally therein, an extension on the sliding tongue, a U-shaped opening in the extension for engaging a connector on a window-moving linkage, a plastic lever connected to the main body for pivoting therein and connected to the plastic sliding tongue for sliding the tongue in the plastic polymer housing as the lever is moved, the sliding tongue further comprises a flat body and a relatively thick rim extending around the flat body, an oval groove formed in the flat body and surrounded by an oval rim, and recesses extending laterally from an end of the oval groove remote from the U-shaped opening.

7. The apparatus of claim 6, further comprising curved lugs in the recesses for holding the sliding tongue in extreme positions.

8. The apparatus of claim 6, wherein the plastic lever has a generally flat shaped handle for moving by a user and has a cylindrical bearing portion and an actuator arm extending radially from the cylindrical bearing portion opposite the handle and an actuating cylinder extending from a remote end of the actuator into the oval groove in the flat body.

9. The apparatus of claim 8, further comprising a recess in an outer surface of the cylindrical bearing and a plastic bearing ring inserted in the recess.

10. Casement window operator apparatus comprising a plastic polymer housing having a plastic main body and a plastic cover, wherein the main body has inward extending reinforced tubular receivers, and wherein the cover has inward projecting pins for fitting in the receivers, a plastic sliding tongue fitted between the cover and the main body for sliding laterally therein, an extension on the sliding tongue, a U-shaped opening in the extension for engaging a connector on a window-moving linkage, and a plastic lever connected to the main body for pivoting therein and connected to the plastic sliding tongue for sliding the tongue in the plastic polymer housing as the lever is moved.

11. The apparatus of claim 10, wherein the pins have radially extending energy directors, wherein the main body has peripheral steps, and wherein the cover has peripheral energy directors, which fit in the peripheral steps for fusing the cover and the main body adjacent the energy directors upon application of ultrasonic energy.

12. Casement window operator apparatus comprising a plastic polymer housing having a plastic main body and a plastic cover, wherein the cover has an inward ledge, which provides a guide for cylindrical extensions, and wherein the main body has parallel guides for guide lugs, a plastic sliding tongue fitted between the cover and the main body for sliding laterally therein, an extension on the sliding tongue, a U-shaped opening in the extension for engaging a connector on a window-moving linkage, and a plastic lever connected to the main body for pivoting therein and connected to the plastic sliding tongue for sliding the tongue in the plastic polymer housing as the lever is moved.

13. Casement window operator apparatus comprising a plastic polymer housing having a plastic main body and a plastic cover, wherein the main body and the cover have semi cylindrical shaped mounts with energy directors on the mounts for fusing the semi cylindrical mounts together into cylindrical mounts upon application of ultrasonic energy, a plastic sliding tongue fitted between the cover and the main body for sliding laterally therein, an extension on the sliding tongue, a U-shaped opening in the extension for engaging a connector on a window-moving linkage, and a plastic lever connected to the main body for pivoting therein and connected to the plastic sliding tongue for sliding the tongue in the plastic polymer housing as the lever is moved.

14. Casement window operator apparatus comprising a plastic polymer housing having a plastic main body and a plastic cover, the plastic main body having a central integrally formed cylindrical bearing opening, an operating lever having a movable handle extending outside of the main body, the operating lever having a central cylindrical bearing extending through the cylindrical bearing opening and having an actuator arm radially extending from the cylindrical bearing and having an actuating cylinder at a remote end of the actuator arm, a plastic sliding tongue fitted between the cover and the main body for sliding laterally therein, an extension on the sliding tongue, a U-shaped opening in the extension for engaging a connector on a window-moving linkage, the actuating cylinder connected to the plastic sliding tongue for sliding the tongue in the plastic polymer housing as the lever is moved, the sliding tongue further comprises a flat body and a relatively thick rim extending around the flat body and a relatively thinner rim extending around the U-shaped opening, wings extending from the flat body and guide lugs extending from the wings, cylindrical guides extending from the flat body opposite from the lugs, an oval groove formed in the flat body and surrounded by an oval rim and receiving the actuating cylinder for sliding the plastic tongue in the body as the handle is moved.

15. Casement window operator apparatus comprising a plastic polymer housing having a plastic main body and a plastic cover, the plastic main body having a central integrally formed cylindrical bearing opening, an operating lever having a movable handle extending outside of the main body, the operating lever having a central cylindrical bearing extending through the cylindrical bearing opening and having an actuator arm radially extending from the cylindrical bearing and having an actuating cylinder at a remote end of the actuator arm, a plastic sliding tongue fitted between the cover and the main body for sliding laterally therein, an extension on the sliding tongue, a U-shaped opening in the extension for engaging a connector on a window-moving linkage, the actuating cylinder connected to the plastic sliding tongue for sliding the tongue in the plastic polymer housing as the lever is moved, the sliding tongue further comprises a flat body and a relatively thick rim extending around the flat body and a relatively thinner rim extending around the U-shaped opening, wings extending from the flat body and guide lugs extending from the wings, cylindrical guides extending from the flat body opposite from the lugs, an oval groove formed in the flat body and surrounded by an oval rim and receiving the actuating cylinder for sliding the plastic tongue in the body as the handle is moved, further comprising recesses extending laterally from an end of the oval groove remote from the U-shaped opening and curved lugs in the recesses for holding the sliding tongue in extreme positions.

16. Casement window operator apparatus comprising a plastic polymer housing having a plastic main body and a plastic cover, the plastic main body having a central integrally formed cylindrical bearing opening, further comprising complementary inward extending reinforced tubular receivers, and inward projecting pins for fitting in the receivers on the main body and cover, and wherein the pins have radially extending energy directors, wherein the main body and the cover have peripheral steps and complementary peripheral energy directors, which fit in the peripheral steps for fusing the cover and the main body adjacent the energy directors upon application of ultrasonic energy, an operating lever having a movable handle extending outside of the main body, the operating lever having a central cylindrical bearing extending through the cylindrical bearing opening and having an actuator arm radially extending from the cylindrical bearing and having an actuating cylinder at a remote end of the actuator arm, a plastic sliding tongue fitted between the cover and the main body for sliding laterally therein, an extension on the sliding tongue, a U-shaped opening in the extension for engaging a connector on a window-moving linkage, the actuating cylinder connected to the plastic sliding tongue for sliding the tongue in the plastic polymer housing as the lever is moved, the sliding tongue further comprises a flat body and a relatively thick rim extending around the flat body and a relatively thinner rim extending around the U-shaped opening, wings extending from the flat body and guide lugs extending from the wings, cylindrical guides extending from the flat body opposite from the lugs, an oval groove formed in the flat body and surrounded by an oval rim and receiving the actuating cylinder for sliding the plastic tongue in the body as the handle is moved.

17. The apparatus of claim 16, further comprising an inward ledge, which provides a guide for the cylindrical extensions, and parallel inward extending guides for the guide lugs on the cover and main body.

18. The apparatus of claim 16, wherein the main body and the cover have semi cylindrical shaped mounts with energy directors on the mounts for fusing the semi cylindrical mounts together into cylindrical mounts upon application of ultrasonic energy.

* * * * *